US005549418A

United States Patent [19]

Devine et al.

[11] Patent Number: 5,549,418

[45] Date of Patent: Aug. 27, 1996

[54] EXPANDED POLYSTYRENE LIGHTWEIGHT FILL

[75] Inventors: John P. Devine; John H. Holmquest, both of Watertown, S. Dak.

[73] Assignee: Benchmark Foam, Inc., Watertown, S. Dak.

[21] Appl. No.: 240,117

[22] Filed: May 9, 1994

[51] Int. Cl.[6] ..... E02D 17/18

[52] U.S. Cl. ..... 405/258; 14/26; 52/309.4; 405/284

[58] Field of Search ..... 14/13, 26, 77.1; 52/309.4; 405/45, 130, 258, 262, 289, 285, 286, 287; 403/283, 300, 306

[56] References Cited

U.S. PATENT DOCUMENTS

| | | | |
|---|---|---|---|
| 3,626,702 | 12/1971 | Monahan . | |
| 3,747,353 | 7/1973 | Monahan . | |
| 4,051,570 | 10/1977 | Hilfiker | 14/26 |
| 4,486,115 | 12/1984 | Rionda et al. | 403/283 |
| 4,564,967 | 1/1986 | Vidal | 14/26 X |
| 4,641,468 | 2/1987 | Slater | 52/309.4 |
| 4,756,645 | 7/1988 | Balzer | 405/286 X |
| 4,889,310 | 12/1989 | Boeshart | 240/41 |
| 4,936,069 | 6/1990 | Hunter et al. | 52/309.4 |

FOREIGN PATENT DOCUMENTS

| | | |
|---|---|---|
| 2171424 | 7/1990 | Japan . |
| 2213520 | 8/1990 | Japan . |
| 369737 | 3/1991 | Japan . |

*Primary Examiner*—Dennis L. Taylor
*Attorney, Agent, or Firm*—Kinney & Lange, P.A.

[57] ABSTRACT

The present invention includes a structure formed on an earthen surface. The structure includes an abutment, a bridge, a plurality of foam blocks, and a pavement structure. The abutment is constructed on the earthen surface. The abutment and the earthen surface define a cavity. The bridge is placed on the abutment. The plurality of blocks are stacked and connected together in the cavity to a desired height. A pavement structure is then formed on the foam blocks. The foam blocks support and retain the pavement structure at a height that is approximately the same as a height of the bridge.

19 Claims, 9 Drawing Sheets

EXPANDED POLYSTYRENE LIGHTWEIGHT FILL

BACKGROUND OF THE INVENTION

The present invention relates generally to backfill for bridge abutments. More particularly, the present invention relates to using lightweight foam as a bridge abutment backfill to provide support for a pavement surface adjacent to a bridge.

The use of conventional concrete and steel abutments in the construction of bridges is known in the art. Bridge abutments typically have a front side and a rear side. The front side is oriented towards the bridge and the rear side is oriented towards a pavement structure that is adjacent to the bridge. Traditionally, bridge abutments are designed to withstand vertical forces from the bridge and horizontal forces from conventional earthen fill beneath the adjacent pavement structure.

In constructing the bridge, it is desirable for the height of the pavement structure to be at approximately the same as the height of the bridge so as to provide a smooth transition when traveling from the pavement structure to the bridge and vice versa. It is also desirable to construct the bridge so that the pavement structure and the bridge remain at approximately the same height when the pavement structure and the bridge are subjected to forces resulting from vehicles traveling over the pavement structure and the bridge.

When the pavement structure and the bridge are not at the same height, vehicles experience a bump when traveling from the pavement structure to the bridge and vice versa. The bump is undesirable because it applies additional forces to the pavement structure and the bridge and because it can be annoying to vehicle drivers. These forces result in a more rapid deterioration rate for the pavement structure and the bridge than would conventionally be expected.

The difference in height between the pavement structure and the bridge typically occurs when the earthen fill beneath the pavement structure settles at a different rate than the abutment. Thus, it is desirable to prevent the earthen fill on the rear side of the abutment from settling.

Adsorption of water into conventional earthen fill material also causes problems when the water freezes and melts. The freezing and melting of the water in the earthen fill causes the earthen fill to expand and contract. As the earthen fill expands and contracts, the pavement structure on top of the earthen fill is shifted. The shifting of the pavement structure results in damage to the pavement structure, which can shorten the life cycle of the pavement structure.

The use of rigid foam to provide a stable roadbed over an unstable soil material is known in the art. The foam is typically used in the form of blocks. The foam blocks are placed in layers to form the desired road bed configuration. As the foam blocks are laid, timber fasteners are positioned at regular intervals to retain the foam blocks in the desired configuration until a pavement structure is formed on the foam block structure. The timber fasteners are formed from metallic materials, such as malleable iron, and have a plurality of outwardly extending spikes.

The use of foam as a base over unstable soil is described in Monahan, U.S. Pat. No. 3,626,702 (the "Monahan '702 patent"). The Monahan '702 patent indicates that polyurethane foam can provide a base beneath a road or building foundation.

Rigid polyurethane foam has also been used as retaining wall backfill as described in Monahan, U.S. Pat. No. 3,747, 353 (the "Monahan '353 patent"). The Monahan '353 patent indicates that the foam reduces pressure on the retaining wall. The polyurethane foam is either cast at the site or formed elsewhere and delivered to the site in slabs. The Monahan '353 patent also discloses that a pavement surface may be formed on the backfill material to provide a level roadway in regions where the terrain is sloped.

None of the prior art references describe using foam block backfill in conjunction with bridge abutments and bridges or in conjunction with constructing buildings on rock surfaces. Accordingly, the references do not appreciate the advantages that foam blocks provide when used to backfill a structure such as a bridge abutment or a dwelling. Furthermore, none of the references disclose using foam block backfill in conjunction with alternative abutment designs, which are made possible because of the reduced horizontal pressure that the foam block backfill exerts on the abutment.

SUMMARY OF THE INVENTION

The present invention includes a structure formed on an earthen or rock surface. The structure includes an abutment, a bridge, a plurality of foam blocks, and a pavement structure. The abutment is constructed on the earthen surface. The bridge is placed on the abutment. The abutment and the earthen surface define a cavity. The plurality of blocks are stacked and connected together in the cavity to a desired height. The pavement structure is then formed on the foam blocks. The foam blocks support and retain the pavement structure at a height that is approximately the same as a height of the bridge.

DETAILED DESCRIPTION OF THE PREFERRED EMBODIMENTS

Figure 1:
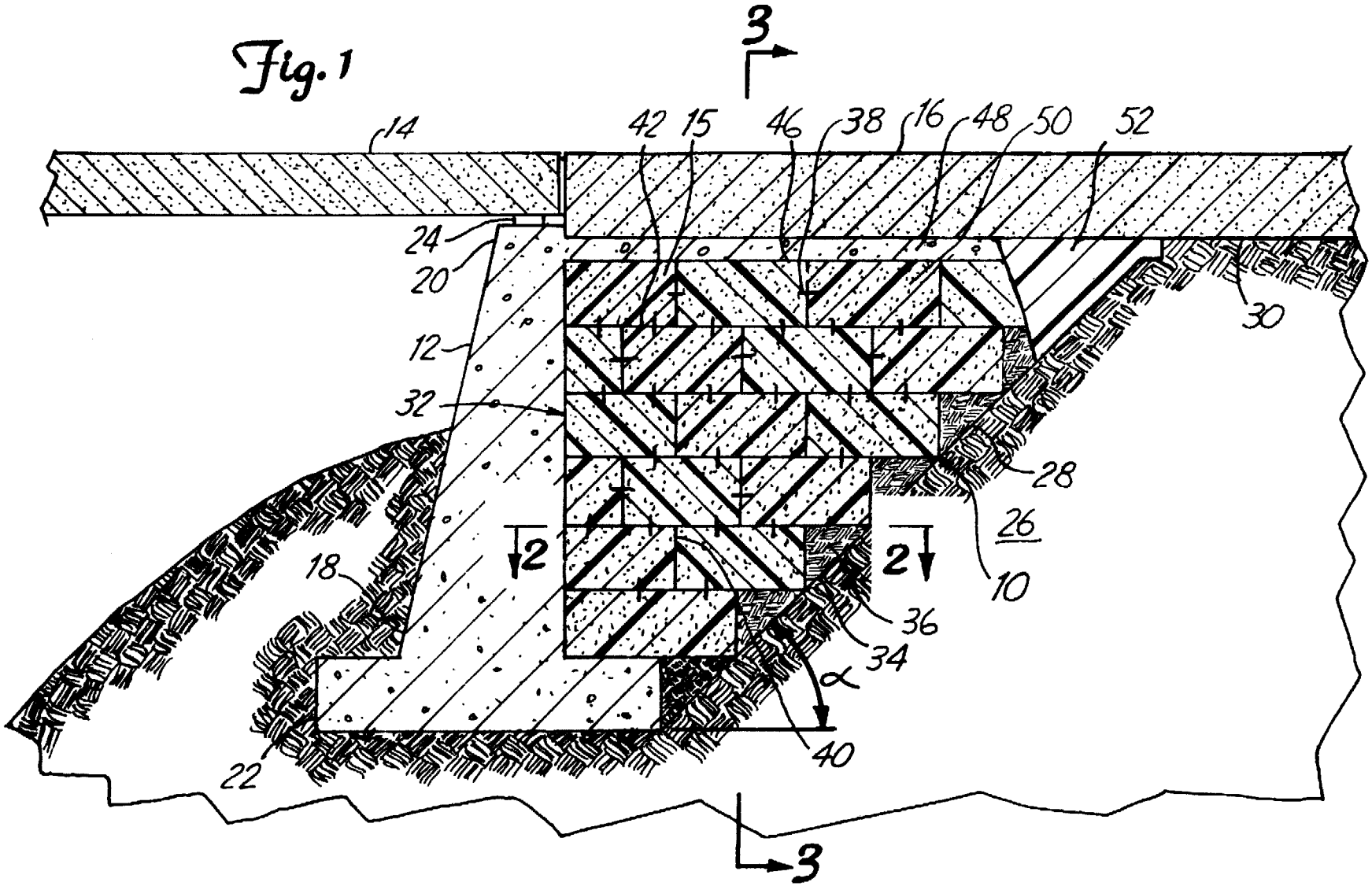
FIG. 1 is a sectional view illustrating the use of foam backfill according to a first preferred embodiment of the present invention.
Figure 2:
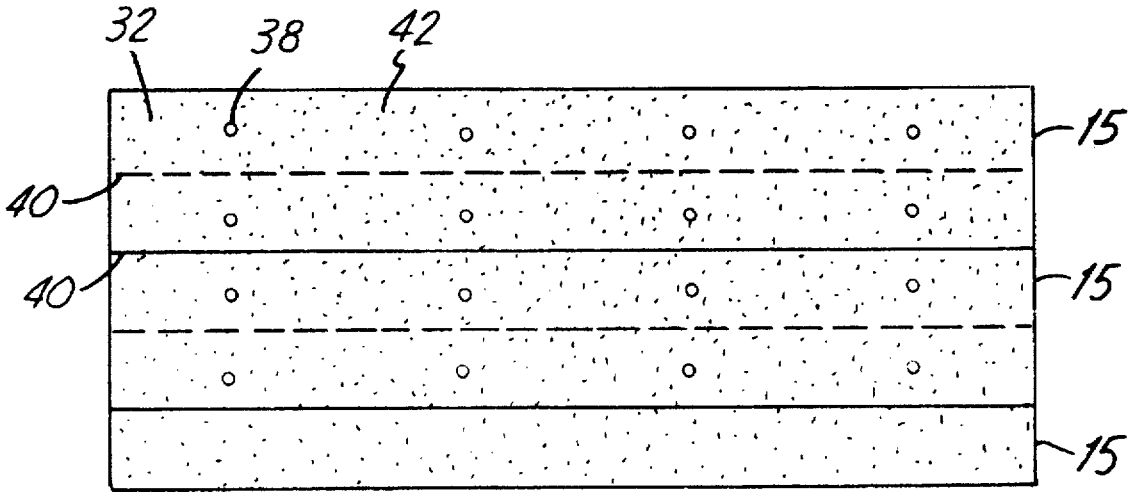
FIG. 2 is a sectional view of the foam block backfill taken along a line 2—2 in FIG. 1.
Figure 3:
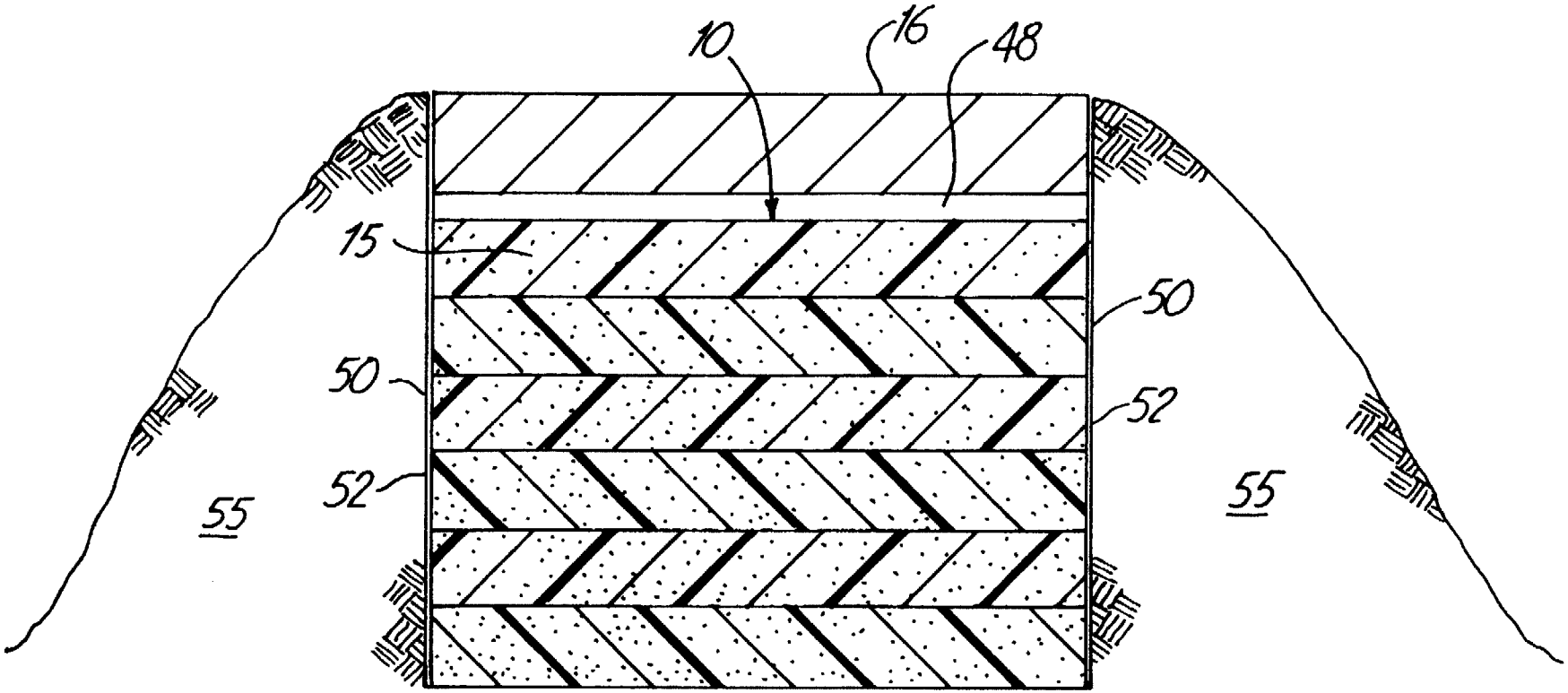
FIG. 3 is a another sectional view of the foam block backfill taken along a line 3—3 in FIG. 1.

A First Embodiment (FIGS. 1–3)

The present invention includes a foam block backfill 10 for a bridge abutment 12, as illustrated in FIG. 1. The bridge abutment 12 supports a bridge 14. The foam block backfill 10, which is constructed from a plurality of foam blocks 15, retains a pavement structure 16 that is formed over the foam block backfill 10 at approximately the same height as the bridge 14.

As a preliminary element, the bridge abutment 12 is constructed. The bridge abutment 12 is either a previously constructed structure or is constructed in conjunction with the foam backfill project. Design and construction of conventional concrete abutments are known in the art.

The bridge abutment 12 includes a lower end 18 and an upper end 20. At the lower end 18 is a footing 22 that supports the bridge abutment 12. The upper end 20 includes a substantially flat surface 24 that is adapted to support the bridge structure 14.

Ground material 26 is tapered to provide a relatively smooth ground surface 28 between a road bed 30 and the footing 22. The ground material 26 is preferably pea rock or other fine aggregate material having a diameter of less than ½ of an inch. The tapering is accomplished using conventional earth moving equipment. After the ground material 26 is tapered to the desired configuration, the ground material 26 is firmly compacted so that a stable base is provided for the foam blocks 15.

The ground surface 28 is oriented at an angle $\alpha$ with respect to the horizontal, which is between 30° and 60°. The angle $\alpha$ is preferably approximately 45°. However, selection of the most appropriate angle $\alpha$ is based on the particular ground material 26 and the amount and type of traffic that is expected to be traveling over the pavement structure 16.

The foam blocks 15 are now placed in an area between the bridge abutment 12 and the ground surface 28. The foam blocks 15 are placed adjacent to each other so that a continuous layer 32 is formed. When fitting the foam blocks 15 in the layer 32, the foam blocks 18 are cut to a desired size. After the layer of foam blocks 15 is laid, an angled area 34 adjacent to the foam blocks 15 and the ground surface 28 is filled with conventional earthen fill 36. The earthen fill 36 is compacted to minimize settling using methods that are known in the art.

A foam block fastener 38 is provided to retain the foam blocks 15 in relation to one another. As the foam blocks 15 are laid, foam block fasteners 38 are placed between the foam blocks 15 to retain the foam blocks 15 in the desired arrangement during the construction process. One foam block fastener 38 is utilized between sides 40 of the foam blocks 15. However, when the length of the foam block side 40 exceeds ten feet, additional foam block fasteners 38 are used.

A layer of foam block fasteners 38 is also placed on the foam block layer 32 as illustrated in FIG. 2. The foam block fasteners 38 are arranged on a top surface 42 of the foam block layer 32 so that the foam blocks 15 are retained in the desired arrangement during the construction process. Approximately one foam block fastener 38 is provided per four square feet of foam block surface 42.

As additional layers of foam blocks 15 are laid, the foam blocks 15 are offset from foam blocks 15 in a preceding layer as illustrated in FIG. 1. Preferably, the foam block side 40 is oriented at the middle of the foam block 18 in the preceding layer.

The foam block backfill structure 10 is then created by repeating the pattern of placing foam block fasteners 38 and then a layer of foam blocks 15 until the foam block backfill structure 10 reaches a desired level. A moisture barrier layer 46 is now placed on the foam blocks 18 to prevent water and petroleum distillates from contacting the foam block backfill structure 10. The moisture barrier layer 46 is preferably a plastic film.

A subbase layer 48 having a thickness of at least 12 inches is then formed over the moisture barrier layer 46. The subbase layer 48 is preferably constructed from coarsely ground gravel. The gravel subbase layer 48 provides a continuous surface for construction of the pavement structure 16.

The pavement structure 16 is now constructed over the gravel subbase layer 48 using methods that are known in the art. The pavement structure 16 may be constructed from asphalt, concrete or gravel based on the desired characteristics of the finished pavement structure 16.

Sides 50 of the foam block backfill structure 10 is protected from petroleum distillates, fire, ultraviolet light, and vandalism. The protection can be accomplished using a number of methods. For example, a moisture barrier plastic film 52 is applied to the foam block backfill structure 10 to prevent moisture from entering the foam block backfill structure 10. Although the moisture barrier plastic film 52 covers the entire side 50, the moisture barrier plastic film 52 has been cut away to allow the foam blocks 15 to be seen.

Earthen fill material 55 is contoured next to the foam block structure 10 to cover the side 50 of the foam block backfill structure 10 as illustrated in FIG. 3. Alternatively, a thin cementuous layer (not shown) is applied over the moisture barrier plastic layer 52. The cementuous layer may also be textured to make the cementuous layer more aesthetically appealing.

The foam block backfill 10 of the present invention exhibits several advantages over conventional earthen fill. Unlike conventional earthen fill, the foam blocks 15 do not settle when subjected to continued forces. As a result, the foam block backfill 10 retains the pavement structure 16 at approximately the same height as the bridge 14. Because the bridge 14 and the pavement 16 remain at approximately the same height, the life cycle of the bridge 14 and the pavement 16 is extended.

Foam blocks 15 also provide a cushion for the pavement structure 16 and thereby reduce shock on the pavement structure 16. By reducing shock on the pavement structure 16, the life cycle of the pavement structure 16 is extended. Furthermore, pavement structures 16 constructed using foam blocks 15 experience lower stresses than those constructed with conventional earthen materials.

Because the foam blocks 15 are much less dense than conventional earthen fill, the foam blocks 15 produce almost no gravity induced stress. Therefore, foam blocks 15 are also highly desirable for areas where the earthen ground material 26 beneath the pavement structure 16 is not capable of supporting much weight. When used in areas where soil is highly erosable or compressible, the foam blocks 15 prevent or at least minimize erosion.

When it is desired to further reduce the weight placed upon the earthen ground material 26, the density of the foam blocks 15 is varied. Foam blocks 15 with a lighter density may be placed near the lower portion of the foam block structure 10 and more dense foam blocks 15 may be used near the upper portion of the foam block structure 10.

Foam blocks 15 typically have a density of between 1.0 and 2.0 pounds per cubic foot. As a result of the relatively low density, the foam block backfill 10 is much easier to move than conventional earthen material. Thus, constructing with foam blocks reduces costs associated with the time, labor, and equipment needed to move conventional earthen material.

The foam block backfill also reduces the operational costs related to maintenance of the pavement structure. Because water is not absorbed into the foam blocks like it is in conventional earthen fill, the foam blocks do not expand and contract as the water freezes and thaws. With conventional earthen fill, freezing and thawing of water causes the earthen fill to expand and contract, which results in movement of the pavement structure placed upon the earthen fill. As the pavement structure moves, it develops cracks that must be filled to prevent further damage to the pavement structure.

The foam blocks 15 are preferably constructed from expanded polystyrene foam. However, the foam blocks 15 can also be manufactured from other polymeric materials that are suitable for expansion, such as expanded polyethylene foam and expanded polypropylene foam.

The expanded polystyrene foam is preferable because it does not degrade by crumbling when used in continuous friction environments. Expanded polystyrene foam blocks are also chemically stable and do not decay easily. A further advantage of expanded polystyrene foam is that chlorofluorocarbon or hyrdochlorofluorocarbon blowing agents, which are banned or will be banned in the near future, are not needed to form the expanded foam blocks.

Preferably, the foam blocks 15 are manufactured using a two-step process that is known in the art. In the first step, foam beads are conveyed into a pre-expansion tank. Steam is fed into the pre-expansion tank to cause the temperature in the pre-expansion tank to rise. As the temperature in the tank approaches 180° F., initial expansion of the foam beads occurs through vaporization of a blowing agent on the foam beads followed by permeation of steam into the foam beads. The amount of foam bead expansion is controlled by volume of foam beads fed into the pre-expansion tank, dwell time in the pre-expansion tank, steam feed rate, steam pressure, steam temperature, and amount of air introduced into the steam. The pre-expanded foam beads are then allowed to age for between 3 and 12 hours.

It has been found that as the unit weight of the foam block 15 increases, the strength of the foam blocks 15 increases. Accordingly, the unit weight of the foam blocks 15 is selected based upon the load that the foam blocks 15 are anticipated to experience. Preferably, the nominal unit weight of the foam blocks 15 is between 1.0 and 2.0 pounds per cubic foot.

The pre-expanded foam beads are fed into a cavity of a block molding machine. The cavity is approximately 16 feet long, 4 feet wide, and 32 inches high. The mold is charged by blowing the beads into the mold or by gravity. Once the mold is filled, the mold is closed and steam is injected into the mold cavity. The steam causes the foam beads to expand and fill out the cavity and thereby fuse together. After expansion is complete, the mold cavity is cooled and a molded foam block 15 is removed.

The foam blocks 15 are now ready for use. The foam block 15 can be cut into a desired shape or used without modification. If it is desired to cut the foam block 15, a band saw or a hot wire may be used. The hot wire is typically preferred because of its speed and versatility.

Figure 5:
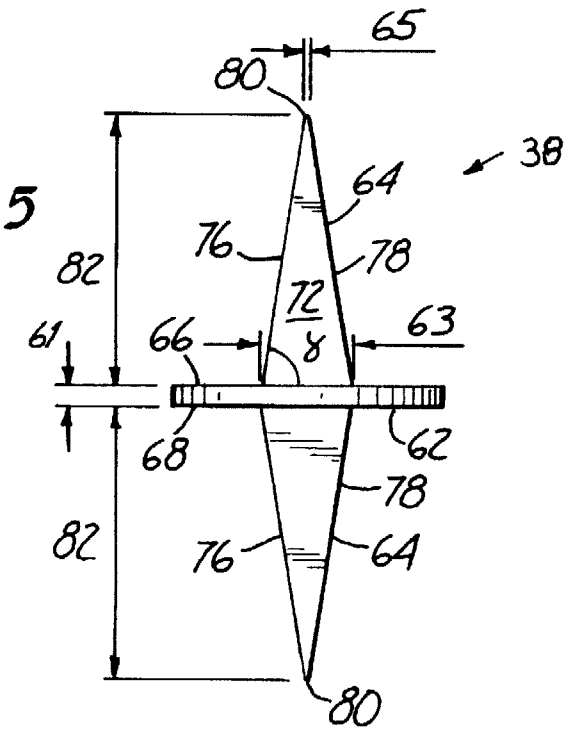
FIG. 5 is a side elevational view of the foam block fastener of FIG. 4.
Figure 6:
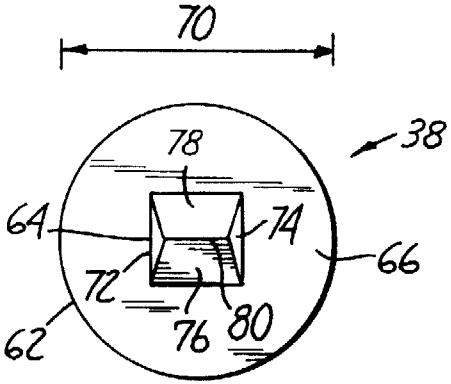
FIG. 6 is a top elevational view of the foam block fastener of FIG. 4.
Figure 4:
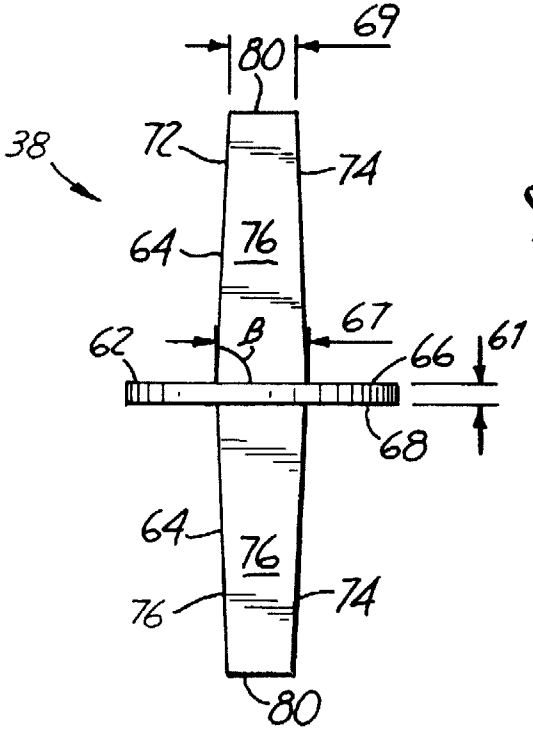
FIG. 4 is a front elevational view of a foam block fastener.

The foam block fastener 38, illustrated in FIGS. 4, 5, and 6, includes a plate 62 and a plurality of spikes 64. The plate 62 has a first major surface 66 and a second major surface 68, which is oriented opposite the first major surface 66. The spikes 64 are formed on the first and second major surface 66, 68.

Typically, only one spike 64 is formed on each of the major surfaces 66, 68 to retain the foam blocks 15 in the desired configuration. However, additional spikes 64 may be placed on each plate 62 if further gripping strength is desired. When only one spike 64 is placed on each of the major surfaces 66, 68, the spikes 64 are preferably oriented opposite each other as illustrated in FIGS. 4 and 5. However, if additional spikes 64 are placed on the major surfaces 66, 68, the spikes 64 may be oriented in other configurations.

The plate 62 is preferably circular in shape and has a thickness 61 of approximately ¼ of an inch. The plate 62 has a diameter 70 that is sufficient to prevent the foam block fastener 38 from penetrating more than a desired depth into the foam block 15. Preferably, the diameter 70 is between 1 inch and 3 inches.

The spikes 64 preferably have surfaces 72, 74, 76 and 78 that taper from the plate 62 to an end 80 opposite the plate 62. A distance 82 between the plate 62 and the end 80 is preferably approximately 3 inches. The side surfaces 72, 74 are oriented at an angle $\beta$ with respect to the plate 62. The front and rear surfaces 76, 78 are oriented at an angle $\gamma$ with respect to the plate 62. The angle $\beta$ is preferably greater than the angle $\gamma$.

The side surfaces 72 and 74 preferably have a base width 63 of 1 inch where the spike 64 intersects the plate 62 and an end width 65 of 1/16 of an inch at the end 80. The front and back surfaces 76, 78 preferably have a base width 67 of 1 inch where the spike 64 intersects the plate 62 and an end width 69 of ¾ of an inch at the end 80. Alternatively, the spikes 64 may be formed in a conical shape.

Preferably, the plate 62 and the spikes 64 are integrally molded from a lightweight plastic material. However, the plate 62 and the spikes 64 may be molded as separate elements and then adhesively bonded to form the foam block fastener 38. While the foam block fastener 38 is preferably injection molded from polypropylene resin, the other methods of molding and materials of construction can be used without departing from the scope and spirit of the invention.

Figure 8:
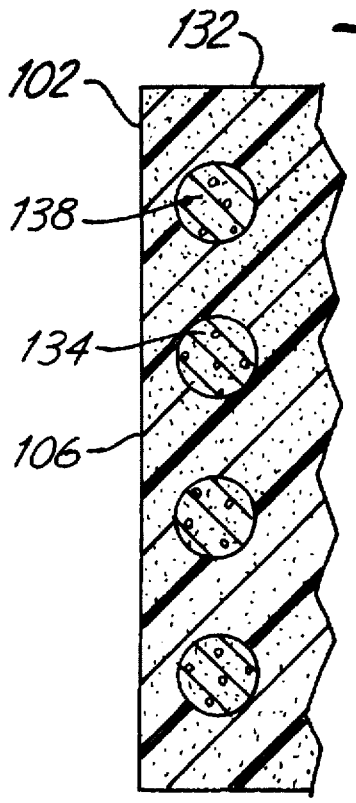
FIG. 8 is a sectional view illustrating the foam block backfill taken along a line 8—8 in FIG. 7.
Figure 7:
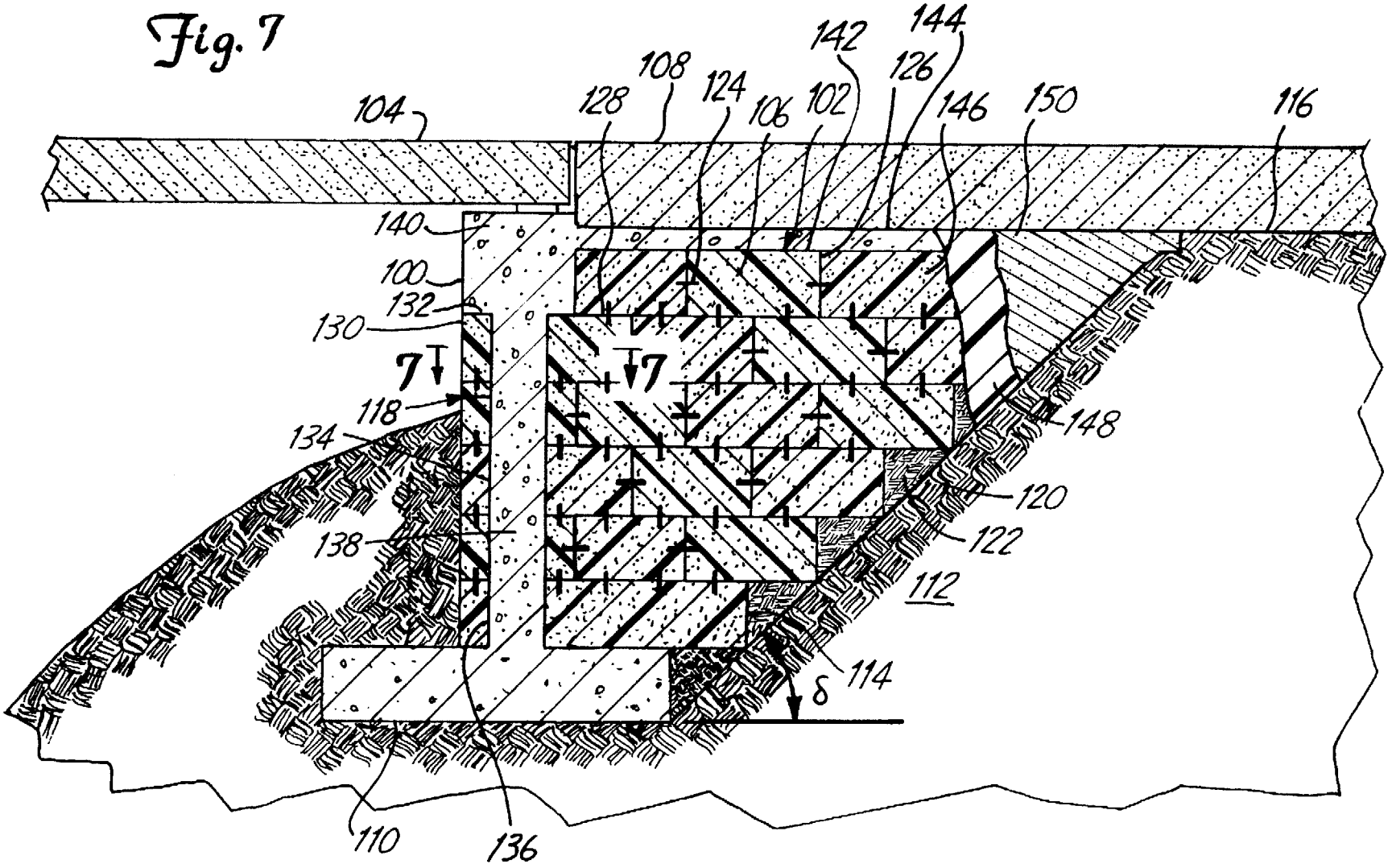
FIG. 7 is a sectional view illustrating the use of foam block backfill, according to a second preferred embodiment of the present invention.

A Second Embodiment (FIGS. 7 and 8)

In an alternative embodiment of the present invention, a bridge abutment 100 is integrally formed with a foam block structure 102 as illustrated in FIG. 7. The integrally formed abutment 100 is possible because the foam block structure 102 exerts very little horizontal force exerted on the abutment 100. The bridge abutment 100 supports a bridge 104. The foam block structure 102, which is constructed from a plurality of foam blocks 106, retains a pavement structure 108 that is formed over the foam block structure 102 at approximately the same height as the bridge 104.

A footing 110 for the abutment 100 is formed from a material that is capable of supporting the abutment, such as concrete. Ground material 112 is tapered to provide a relatively smooth ground surface 114 between a road bed 116 and the footing 110. The ground material 26 is preferably pea rock or other fine aggregate material having a diameter of less than ½ of an inch. The tapering is accomplished using conventional earth moving equipment. The ground material 112 is firmly compacted so that a stable base is provided for the foam blocks 106.

The ground surface 114 is oriented at an angle δ with respect to the horizontal, which is between 30° and 60°. The angle δ is preferably approximately 45° but selection of the most appropriate angle is based on the particular ground material 112 and the amount and type of traffic that is expected to be traveling over the finished structure.

Foam blocks 106 are now placed in an area that is adjacent to the ground surface 114. The foam blocks 106 in this embodiment extend from the ground surface 114 to an area where the abutment 100 is to be constructed. The foam blocks 106 are placed adjacent to each other so that a continuous layer 118 is formed. When fitting the foam blocks 106 in the layer 118, the foam blocks 106 are cut to a desired size.

After the layer 118 of foam blocks 106 is laid, an angled area 120 adjacent to the foam block 106 and the ground surface 114 is filled with conventional earthen fill 122. The earthen fill 122 is compacted to minimize settling using methods that are known in the art.

Similar to the embodiment illustrated in FIG. 1, foam block fasteners 124 are placed between the foam blocks 106 to retain the foam blocks 106 in the desired arrangement during the construction process. One foam block fastener 124 is utilized between sides 126 of the foam blocks 106. However, when the length of the foam block side 126 exceeds ten feet, additional foam block fasteners 124 may be used. The foam block fasteners 124 are also placed on a top surface 128 of the foam block layer 118. Approximately one foam block fastener 124 is provided per four square feet of foam block surface.

As additional layers of foam blocks 106 are laid, the foam blocks 106 are offset from foam blocks 106 in a preceding layer. Preferably, the foam block side is oriented at the middle of the foam block 106 in the preceding layer.

The foam block structure 102 is created by repeating the pattern of placing foam block fasteners 124 and then a layer of foam blocks 106 until the foam block structure 102 reaches a desired height. As the foam blocks 106 are placed in the foam block structure 102, the foam are cut so that a smooth outer wall 130 is formed by the foam blocks 106.

The foam block structure 102 is cored from a top surface 132 to the footing 110 to form a cylindrical cavity 134 as illustrated in FIG. 8. The number and diameter of the cavities is based on the weight that the abutment 100 is expected to support. Alternatively, the foam blocks 106 are cored to form a cylindrical cavity portion 136 prior to installation. If the foam blocks 106 are cored prior to installation, care must be exercised to ensure that the cylindrical cavity portions 136 align to form the cylindrical cavity 134.

A concrete column 138 is created by filling the cylindrical cavity 134 with concrete as illustrated in FIG. 7. Failure to properly align the cylindrical cavity portions 136 will preclude a sufficiently strong concrete column 138 from being formed in the cylindrical cavity 134. If it is desired to further reinforce the concrete column 138, steel reinforcing bars (not shown) are placed in the cylindrical cavity 134 prior to filling the cavity 134 with concrete.

A horizontal beam 140 is constructed from concrete above the concrete columns 138. Similar to the concrete columns 138, the horizontal beam 140 can be reinforced, if desired, to form a stronger structure.

Next, a moisture barrier layer 142 is placed on the foam block structure 102 to prevent water and petroleum distillates from contacting the foam block structure 122. The moisture layer 142 is preferably a plastic film.

A subbase layer 144 having a thickness of at least 12 inches is now formed over the foam block structure 102. The subbase layer 144 is preferably constructed from coarse ground gravel. The gravel subbase layer 144 provides a continuous surface for the pavement structure 108.

The pavement structure 108 is then constructed on the gravel subbase layer 144 using methods that are known in the art. The pavement structure 108 may be constructed from asphalt, concrete or gravel based on the desired characteristics of the finished structure.

Sides 146 and the outer wall 130 of the foam block structure 102 is protected from petroleum distillates, fire, ultraviolet light, and vandalism. The protection can be accomplished using a number of methods. For example, a moisture barrier plastic film 148 is applied to the foam block structure 102 to prevent moisture from entering the foam block structure 102. Although the moisture barrier plastic film 148 covers the entire sides 146 and the outer wall 130, the moisture barrier plastic film 148 has been cut away to allow the foam blocks 106 to be seen.

A thin cementuous layer 150 is then applied over the moisture barrier plastic layer 148. Although the cementuous layer 150 covers the entire side 146 and the outer wall 130, the cementuous layer 150 has been cut away to allow the foam blocks 106 and the moisture barrier plastic film 148 to be seen. The cementuous layer 150 may also be textured to make it more aesthetically appealing. Alternatively, earthen fill material (not shown) may be used to cover the exposed surfaces of the foam blocks 106.

Figure 9:
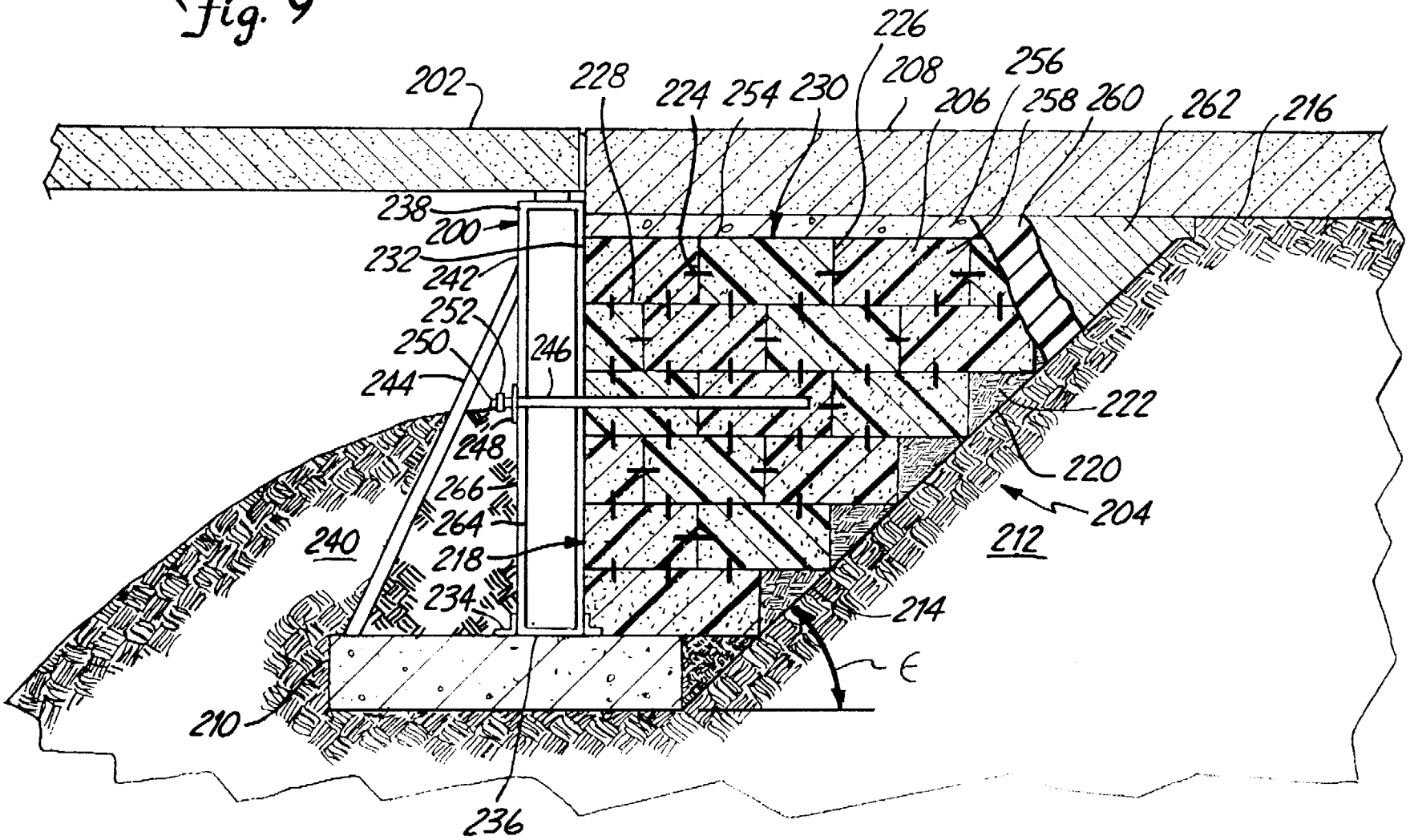
FIG. 9 is a sectional view illustrating the use of foam block backfill, according to a third preferred embodiment of the present invention.
Figure 10:
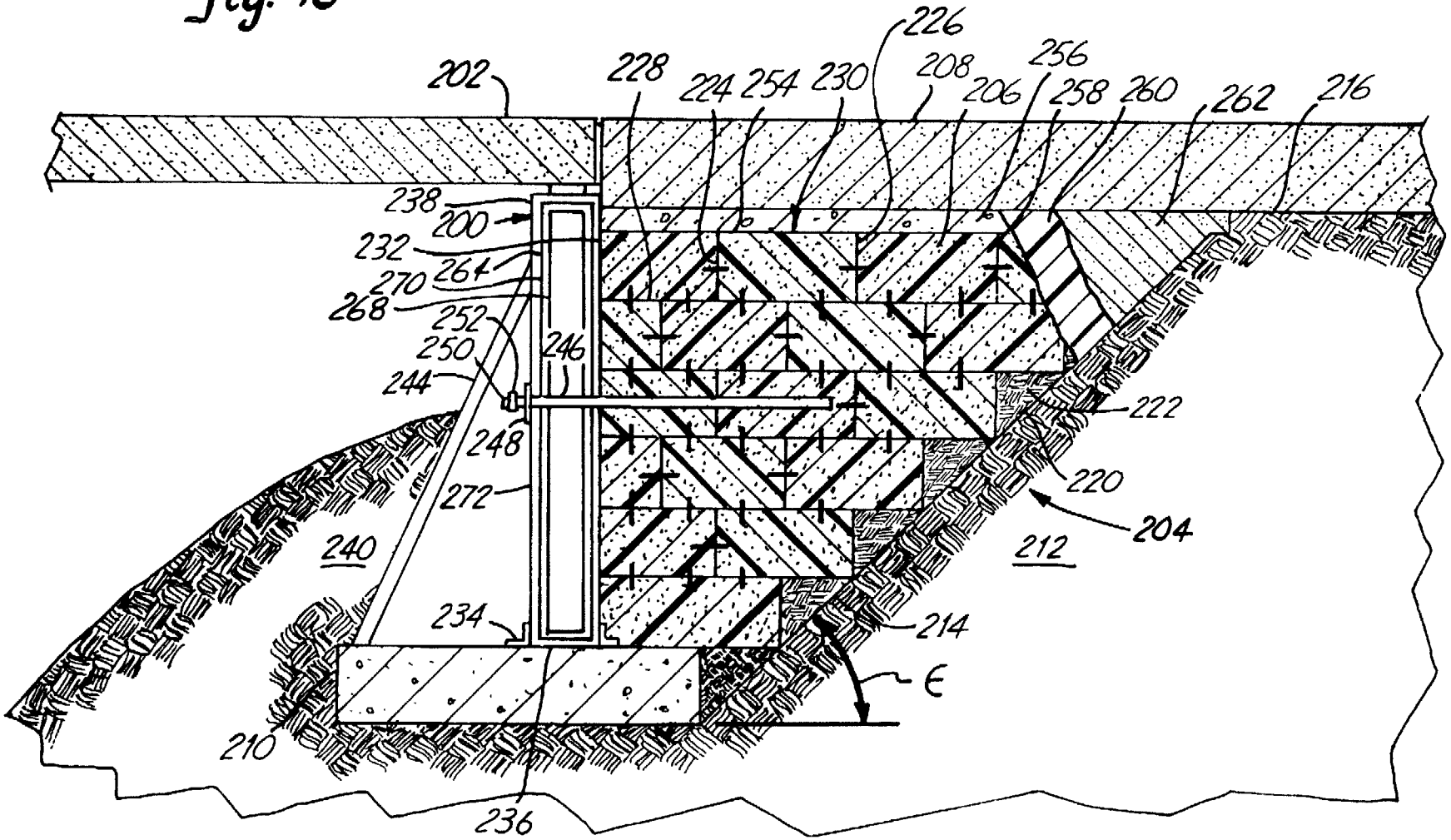
FIG. 10 is a sectional view illustrating the use of foam block backfill, according to the present invention, with still another alternative abutment design.

A Third Embodiment (FIGS. 9 and 10)

As an alternative to using a conventional concrete abutment, a multi-layer laminate structure 200 is used as an abutment to support a bridge 202 as illustrated in FIG. 9. Foam block backfill 204 is then placed behind the multi-layer laminate structure 200. The foam block backfill 204, which is constructed from a plurality of foam blocks 206, retains a pavement structure 208 that is formed over the foam block backfill 204 at approximately the same height as the bridge 202.

A footing 210 is formed to support the multi-layer laminate structure 200. The footing is preferably formed from concrete. Ground material 212 is tapered to provide a relatively smooth ground surface 214 between a road bed 216 and the footing 210, The ground material 26 is preferably pea rock or other fine aggregate material having a diameter of less than ½ of an inch. Tapering is accomplished using conventional earth moving equipment. The ground material 212 is firmly compacted so that a stable base is provided for foam blocks 206.

The ground surface 214 is oriented at an angle ϵ with respect to the horizontal, which is between 30° and 60°. The angle ϵ is preferably approximately 45° but selection of the most appropriate angle ϵ is based on the particular ground material 212 and the amount and type of traffic that is expected to be traveling over the finished pavement structure 208.

Foam blocks 206 are now placed in an area that is adjacent to the ground surface 214. The foam blocks 206 in this embodiment extend from the ground surface 214 to an area where the multi-layer laminate structure 200 is to be erected. The foam blocks 206 are placed adjacent to each other so that a continuous layer 218 is formed. When fitting the foam blocks 206 in the layer, the foam blocks 206 are cut to a desired size.

After the layer of foam blocks 206 is laid, an angled area 220 adjacent to the foam blocks 206 and the ground surface 214 is filled with conventional earthen fill 222. The earthen fill 222 is compacted to minimize settling using methods that are known in the art.

Similar to the embodiment illustrated in FIG. 1, foam block fasteners 224 are placed between the foam blocks 206 to retain the foam blocks 206 in the desired arrangement during the construction process. One foam block fastener 224 is utilized between sides 226 of the foam blocks 206. However, when the length of the foam block side 226 exceeds ten feet, additional foam block fasteners 224 may be used. The foam block fasteners 224 are also placed on a top surface 228 of the foam block layer 218. Approximately one foam block fastener 224 is provided per four square feet of foam block surface.

As additional layers of foam blocks 206 are laid, the foam blocks 206 are offset from foam blocks 206 in a preceding layer. Preferably, the foam block side 226 is oriented at the middle of the foam block 206 in the preceding layer. A foam block structure 230 is then created by repeating the pattern of placing foam block fasteners 224 and then a layer of foam blocks 206 until the foam block structure 230 reaches a desired height. The foam blocks 206 are cut so that a smooth outer wall 232 is formed by the foam blocks 206.

An angle bracket 234 is mounted to the footing 210. The angle bracket 234 retains a lower end 236 of the multi-layer laminate structure 200 in a desired position with respect to the foam block structure 230. The multi-layer laminate structure 200 is now erected between the angle bracket 234 and the foam block structure 230.

An upper end 238 of the multi-layer laminate structure 200 is retained in a stationary position by placing earthen fill 240 against a front surface 242 of the multi-layer laminate structure 200. Alternatively, the multi-layer laminate structure 200 is retained in a stationary position with a metal bracket 244 that is mounted to the footing 210 and the multi-layer laminate structure 200. Still another alternative for retaining the multi-layer laminate structure 200 in a stationary position is using a steel rod 246. The rod 246 is placed through the multi-layer laminate structure 200 and into the foam block structure 230 where it is retained. A plate 248 is put on an end 250 of the rod 246 that extends from the multi-layer laminate structure 200. The plate 248 is preferably retained on the end 250 of the rod 246 using a threaded nut 252.

A moisture barrier 254 is then placed on the foam block structure 230 to prevent water and petroleum distillates from contacting the foam block structure 230. The moisture barrier 254 is preferably a plastic film.

A subbase layer 256 having a thickness of at least 12 inches is now formed on the foam block structure 230. The subbase layer 256 is preferably constructed from coarse ground gravel. The gravel subbase layer 256 provides a continuous surface for the pavement structure 208.

The pavement structure 208 is next constructed on the gravel subbase layer 256 using methods that are known in the art. The pavement structure 208 may be constructed from asphalt, concrete or gravel based on the desired characteristics of the finished pavement structure 208.

Sides 258 of the foam block structure 230 is protected from petroleum distillates, fire, ultraviolet light, and vandalism. The protection may be accomplished by using a number of methods. For example, a moisture barrier film 260 is applied to the side 258 to prevent moisture from entering the foam block structure 230. Although the moisture barrier plastic film 260 covers the entire side 258, the moisture barrier plastic film 260 has been cut away to allow the foam blocks 206 to be seen.

A thin cementuous layer 262 is then applied to the sides 258. Although the cementuous layer 262 covers the entire sides 258, the cementuous layer 262 has been cut away to allow the foam blocks 206 and the moisture barrier plastic film 260 to be seen. The cementuous layer 262 may also be textured to make it more aesthetically appealing. Alternatively, earthen fill material (not shown) is contoured next to the side 258 to cover the exposed surfaces of the foam blocks 206.

The multi-layer laminate structure 200 includes a foam core 264 that is surrounded by a fiber-reinforced plastic matrix 266. Additional features and advantages of the multi-layer laminate structure are disclosed in a copending application entitled MULTI-LAYER LAMINATE STRUCTURE, which was invented by the same inventors as the present application.

The core 264 preferably has a thickness of between 8 inches and 16 inches, a width of between 6 feet and 20 feet, and a height of up to 20 feet. The core 264 is formed from expanded polystyrene foam, expanded polyethylene foam, expanded polypropylene foam, or a copolymer thereof. The core 264 is preferably constructed from a polyethylene-polystyrene copolymer foam. The ratio of polyethylene to polystyrene in the polyethylene-polystyrene copolymer foam is preferably between 1:1 and 5:1.

Preferably, the polyethylene-polystyrene copolymer foam is ARCEL® foam, which can be obtained from ARCO Chemical Company of New Town Square, Pa. ARCEL® foam is a dosed-cell moldable copolymer having a pre-expanded density of between 1.5 and 3.0 pounds per cubic foot. Conventional expanded polystyrene equipment and processes with modifications as needed and knowledge of ARCEL® molding technology are used to form ARCEL® foam beads into foam blocks having a desired size.

The fiber-reinforced plastic matrix 266 preferably has a thickness of ⅛ of an inch and greater. The fiber-reinforced plastic matrix 266 is constructed from glass fibers having a diameter of between 0.0001 and 0.001 inches and an average length of between ⅛ of an inch and 2 inches. The glass fibers are preferably supplied in a chopped strand mat having a thickness of between ⅛ of an inch and ½ of an inch.

The fibers for the fiber-reinforced plastic matrix 266 can also be constructed from other materials that are known in the art, such as carbon, graphite, aramid, polyester, and boron. Selection of the particular fiber material is based on the desired strength, torque resistance, and other physical properties of the multi-layer laminate structure 200.

A resin is then mixed with the fibers. The resin is either nylon, polycarbonate, acetal, polyethylene or polyester based material. Selection of the resin is known in the art and should be done based on the conditions and stresses that will be placed upon the multi-layer laminate structure 200.

The multi-layer laminate structure 200 is preferably formed by either vacuum bagging, pressure forming, or hand lay-up. Vacuum bagging is suited to forming a laminate structure with high fiber content, high interlaminate bond strengths and reduced weight. In vacuum bagging, the fiber-reinforced plastic matrix 266 is wrapped around the core 264 and then positioned in a mold. A vacuum bag is sealed around the perimeter of the mold and a vacuum is applied. As a result of the air between the vacuum bag and the mold being removed, the atmospheric pressure against the vacuum bag forces the vacuum bag against the foam core 264 and the fiber-reinforced plastic matrix 266 and thereby causes the multi-layer laminate structure 200 to be formed.

Alternatively, the multi-layer laminate structure 200 is pressure formed. In pressure forming, the fiber-reinforced plastic matrix 266 is wrapped around the core 264 and then placed in a flexible bag. Pressures of up to 50 psi are then applied to force the bag against a mold. As a result of the pressure the fiber-reinforced plastic matrix 266 bonds with the foam core 264 and thereby forms the multi-layer laminate structure 200.

The multi-layer laminate structure 200 can also be formed using hand lay-up techniques. With hand lay-up, the resin is applied over the foam core 264. The fiber-reinforced plastic matrix is applied and then another layer of resin is applied. The multi-layer laminate structure is then cured to form the multi-layer laminate structure 200.

The foam core 264 may also be constructed with multiple components that include a first core portion 268 and a second core portion 270 as illustrated in FIG. 10. The first core portion 268 is preferably entirely covered by the second core portion 270. The multi-component core 264 is then covered by a fiber-reinforced plastic matrix 272. The multicomponent core 264 provides for greater flexibility when designing the multi-layer laminate structure 200.

The multi-layer laminate structure 200 enables the weight of the abutment to be greatly reduced when compared to a conventional concrete abutment. The multi-layer laminate structure 200 also dampens vibrations that are transmitted to it from the bridge 202 that is placed upon the multi-layer laminate structure 200. As a result the life span for the bridge and the multi-layer laminate structure 200 is longer than would conventionally be expected.

Use of the multi-layer laminate structure 200 also enables the construction time to be significantly reduced. The time consuming elements of constructing a conventional concrete abutment, such as assembling a concrete form structure and allowing the concrete to cure, are not required when using a multi-layer laminate structure as a bridge abutment.

Figure 11:
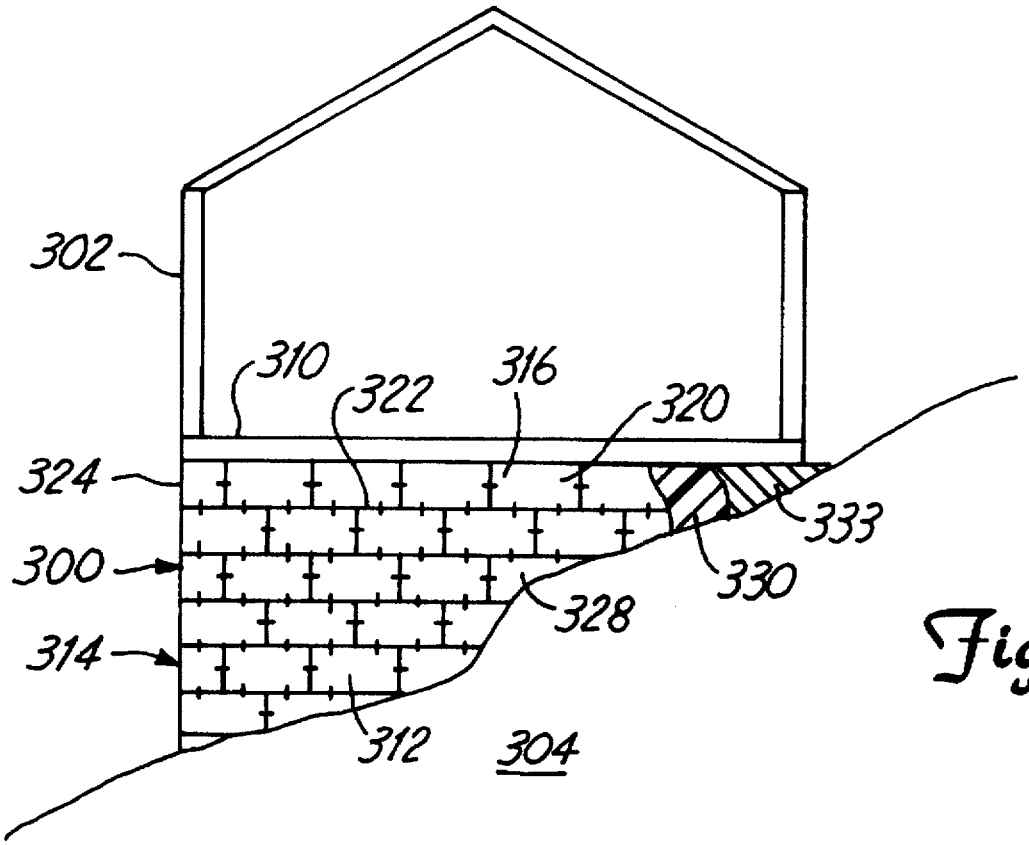
FIG. 11 is a sectional view illustrating the use of foam block backfill, according to a fourth preferred embodiment of the present invention.
Figure 12:
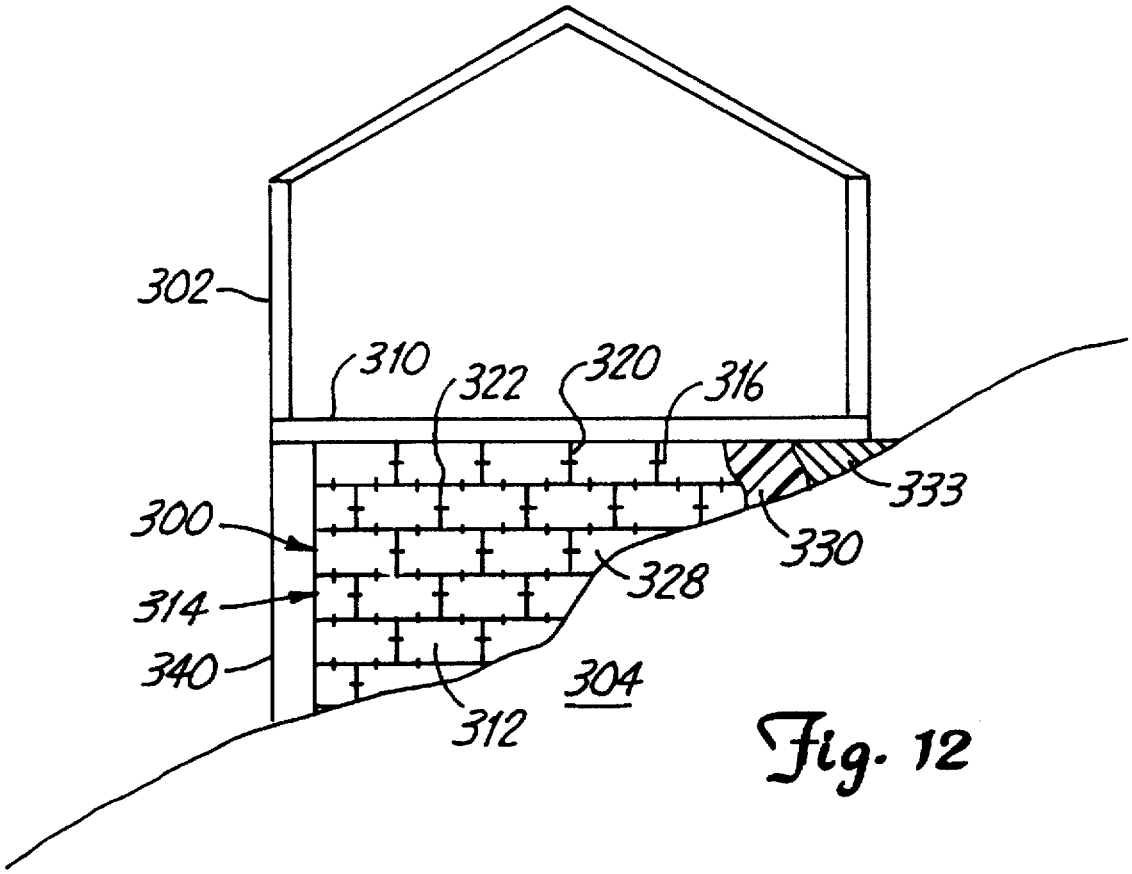
FIG. 12 is a sectional view illustrating the use of foam block backfill, according to a fourth preferred embodiment of the present invention in conjunction with a foundation.

A Fourth Preferred Embodiment (FIGS. 11 and 12)

In this embodiment, foam block backfill 300 provides support for a building 302 on a rock surface 304 as illustrated in FIG. 11. The foam block backfill 300 also provides a stable base for the building 302 that does not settle over time like conventional earthen fill, which is presently used to support buildings constructed on rock surfaces.

The foam block backfill 300 is especially important when the rock surface 304 is oriented at an angle with respect to a horizontal plane. Even when conventional earthen fill is compacted to minimize settling, the earthen fill shifts along the angled ground surface 304 over time. As a result of the shifting, a base 310 upon which the building 302 sits no longer has support. The lack of support can lead to cracking of the base 310 and possibly damage to the building 302.

The rock surface 304 is prepared for construction of the building 302 by removing any loose rocks. Foam blocks 312 are now placed in an area that is adjacent to the rock surface 304. The foam blocks 312 in this embodiment extend from the rock surface 304 to an area where a side of the building is to be constructed.

The foam blocks 312 are placed adjacent to each other so that a continuous layer 314 is formed. When fitting the foam blocks 312 in the layer 314, the foam blocks 312 are cut to a desired size. Unlike the preceding embodiments, the foam blocks 312 are cut so that they follow the rock surface 304.

If it is desired to provide additional stability to the foam block structure 300, angle brackets (not shown) may be anchored to the rock surface 304 along the downhill side of the foam block 312. The angle brackets will thereby serve as an additional element to prevent the foam blocks 312 from moving with respect to the rock surface 304.

Similar to the embodiment illustrated in FIG. 1, foam block fasteners 316 are placed between the foam blocks 312 to retain the foam blocks 312 in the desired arrangement during the construction process. One foam block fastener 316 is utilized between sides 320 of the foam blocks 312. However, when the length of the foam block side 320 exceeds ten feet, additional foam block fasteners 316 may be used. The foam block fasteners 316 are also placed on a top surface 322 of the foam block layer 314. Approximately one foam block fastener 316 is provided per four square feet of foam block surface.

As additional layer of foam blocks 312 are laid, the foam blocks 312 are offset from foam blocks 312 in a preceding layer. Preferably, the foam block side is oriented at the middle of the foam block 312 in the preceding layer.

The foam block structure 300 is created by repeating the pattern of placing foam block fasteners 316 and then a layer of foam blocks 312 until the foam block structure 300 reaches a desired height. As the foam blocks 312 are placed on the foam block structure 300, the foam blocks are cut so that a smooth outer wall 324 is formed by the foam blocks 312.

The base 310 is now formed for the building 302. The base 310 can be constructed from wood, concrete, stone, or other materials that are known in the art. The building 302 can then be constructed on top of the base 310 using desired building materials.

Sides 328 of the foam block structure 300 are protected from petroleum distillates, fire, ultraviolet light, and vandalism. The protection can be accomplished using a number of methods. For example, a moisture barrier plastic film 330 is applied to the foam block structure 300. Although the moisture barrier plastic film 330 covers the entire sides 328, the moisture barrier film 330 has been cut away to allow the foam blocks 312 to be seen.

A thin cementuous layer 333 is then applied over the moisture barrier plastic film 330. Although the cementuous layer 333 covers the entire side 328, the cementuous layer 333 has been cut away to allow the foam blocks 312 and the moisture barrier plastic film 330 to be seen. The cementuous layer may also be textures to make it more aesthetically appealing. Alternatively, earthen fill material (not shown) may be used to cover the exposed surfaces of the foam blocks 312.

If it is desired, a foundation wall 340 can be formed adjacent to the foam block structure 300 as illustrated in FIG. 12. The foundation 340 can either be constructed before or after the foam block structure 300 is formed.

The foundation 340 is anchored into the rock surface 304 and supports the building 302. The foundation 340 may be constructed from concrete blocks, concrete, or a concrete-polystyrene system. One such concrete-polystyrene system is described in Boeshart, U.S. Pat. No. 4,889,310. Boeshart discloses opposed polystyrene panels that are stacked to form a pair of parallel, spaced-apart walls. The space between the polystyrene panels is then filled with concrete. The polystyrene panels can either be removed after the concrete sets or left on the concrete wall to serve as permanent insulation.

Although the present invention has been described with reference to preferred embodiments, workers skilled in the art will recognize that changes may be made in form and detail without departing from the spirit and scope of the invention.

What is claimed is:

1. A structure formed on a sloping earthen surface, the structure comprising:

an abutment constructed on the earthen surface, the abutment and the earthen surface defining a cavity;

a bridge placed on the abutment so that an end of the bridge rests on the abutment, the bridge having a top surface over which vehicles are driven;

a plurality of foam blocks stacked and connected together in the cavity to a desired height;

a moisture barrier layer placed over the stack of foam blocks;

a subbase layer placed over the moisture barrier layer; and a pavement structure formed on the subbase layer, the foam blocks support the pavement structure and retain a top surface of the pavement structure substantially coplanar with the top surface of the bridge.

2. The structure of claim 1 wherein the foam blocks are selected from the group consisting of expanded polystyrene foam, expanded polyethylene foam, and expanded polypropylene foam.

3. The structure of claim 1 wherein the foam blocks have various densities.

4. The structure of claim 3 wherein the foam blocks are stacked to form a foam block structure having a lower portion and an upper portion with the foam blocks in the upper portion having a greater density than the foam blocks in the lower portion.

5. The structure of claim 1 wherein the foam blocks are retained in relation to each other using a foam block fastening device, the foam block fastening device comprising a plate and a plurality of spikes, the spikes extending outwardly from both sides of the plate, the plate and the spikes being formed from a lightweight plastic material, wherein the Spikes extend into abutting surfaces of adjoining foam blocks.

6. A structure formed on an earthen surface that generally slopes in a first direction, the structure comprising:

supporting means for supporting a bridge constructed on the earthen surface, the supporting means and the earthen surface defining a cavity;

a bridge placed on the supporting means, the bridge extending from the supporting means in the first direction;

a plurality of foam blocks stacked and connected together in the cavity to a desired height, the foam blocks forming a foam block structure; and a pavement structure formed on the foam blocks, the pavement structure having a top surface, the foam blocks support the pavement structure and retain the top surface of the pavement structure substantially coplanar with the top surface of the bridge so that vehicles do not experience a bump when moving between the top surface of the pavement structure and the top surface of the bridge.

7. The structure of claim 6 wherein the means for supporting the bridge is a conventional concrete abutment.

8. The structure of claim 6 wherein the means for supporting the bridge comprises:

a plurality of columns that are formed in at least a portion of the foam structure; and a beam that is formed on and supported by the columns, the beam supporting the bridge.

9. The structure of claim 8 wherein the columns are constructed from reinforced concrete.

10. The structure of claim 8 wherein the beam is constructed from reinforced concrete.

11. The structure of claim 6 wherein the means for supporting the bridge is a multi-layer laminate structure.

12. The structure of claim 11 wherein the multi-layer laminate structure comprises:

a first expanded foam element;

a second expanded foam element, the first expanded foam element is substantially covered by the second expanded foam element to form a core unit; and a fiber-reinforced plastic matrix is formed over the core unit.

13. The structure of claim 12 wherein the first and second expanded foam elements are constructed from the same material such that the core unit comprises a single component.

14. The structure of claim 12 wherein the first expanded foam element is selected from the group consisting of expanded polystyrene foam, expanded polypropylene foam, expanded polyethylene foam, and expanded polyethylene-polystyrene copolymer foam.

15. The structure of claim 12 wherein the second expanded foam element is selected from the group consisting of expanded polystyrene foam, expanded polypropylene foam, expanded polyethylene foam, and expanded polyethylene-polystyrene copolymer foam.

16. The structure of claim 9 wherein the foam blocks have various densities.

17. The structure of claim 16 wherein the foam block structure has a lower portion and an upper portion with the foam blocks in the upper portion having a greater density than the foam blocks in the lower portion.

18. The structure of claim 6 wherein the foam blocks are retained in relation to each other using a foam block fastening device, the foam block fastening device comprising a plate and a plurality of spikes, the spikes extending outwardly from both sides of the plate, the plate and the spikes being formed from a lightweight plastic material, wherein the spikes extend into abutting surfaces of adjoining foam blocks.

19. A method of forming a structure on a sloping earthen surface, the method comprising the steps of:

erecting an abutment on the earthen surface, the abutment and the earthen surface defining a cavity;

placing a bridge on the abutment so that an end of the bridge is supported by the abutment, the bridge having a top surface;

stacking a plurality of foam blocks in the cavity until the cavity is filled to a desired level;

connecting the foam blocks so that the foam blocks remain in a desired configuration; and forming a pavement structure on the foam blocks, the pavement structure having a top surface, the foam blocks supporting the pavement structure; and retaining the top surface of the pavement structure substantially coplanar with the top surface of the bridge, wherein the foam block structure has a lower portion and an upper portion with the foam blocks in the upper portion having a greater density than the foam blocks in the lower portion.

* * * * *

UNITED STATES PATENT AND TRADEMARK OFFICE

CERTIFICATE OF CORRECTION

PATENT NO. : 5,549,418

DATED : AUGUST 27, 1996

INVENTOR(S) : JOHN P. DEVINE, JOHN H. HOLMQUEST

It is certified that error appears in the above-indentified patent and that said Letters Patent is hereby corrected as shown below:

Col. 8, line 44, after "210", delete ",", insert --.--

Col. 10, line 32, delete "dosed-cell", insert --closed-cell--

Col. 11, lines 22 & 23, delete "mul-ticomponent", insert --multi-component--

Col. 13, line 39, delete "Spikes", insert --spikes--

Signed and Sealed this

Tenth Day of December, 1996

*Attest:*

*Attesting Officer*

Bruce Lehman

BRUCE LEHMAN

*Commissioner of Patents and Trademarks*